US005238727A

United States Patent [19]

Abe et al.

[11] Patent Number: 5,238,727

[45] Date of Patent: Aug. 24, 1993

[54] HEAT TRANSFER INK RIBBON

[75] Inventors: Tetsuya Abe; Yoshio Fujiwara, both of Tochiga, Japan

[73] Assignee: Sony Corporation, Tokyo, Japan

[21] Appl. No.: 756,277

[22] Filed: Sep. 6, 1991

[30] Foreign Application Priority Data

Sep. 7, 1990 [JP] Japan ..... 2-238355

[51] Int. Cl.[5] ..... R02B 9/00

[52] U.S. Cl. ..... 428/204; 428/206; 428/195; 428/913; 106/20 R

[58] Field of Search ..... 400/241.1; 8/471; 428/204, 206, 411.1, 913

[56] References Cited

U.S. PATENT DOCUMENTS 3,508,492 4/1970 Seibert ..... 8/471

FOREIGN PATENT DOCUMENTS 0429666 6/1991 European Pat. Off. .
862-138512 6/1987 Japan .
63-3011 1/1988 Japan .
2-72993 3/1990 Japan .

*Primary Examiner*—Mark L. Bell
*Assistant Examiner*—Margaret Einsmann
*Attorney, Agent, or Firm*—Hill, Steadman & Simpson

[57] ABSTRACT

Disclosed herein is a heat transfer ink ribbon characterized by that the ink layer is made with a binder resin which is a graft polymer formed by grafting a backbone polymer with a vinyl compound of cyclic structure having a ring comprised of 4 or more atoms. This binder resin helps the ink ribbon to have an optimum gamma value and reproduce the smooth gradation.

2 Claims, No Drawings

HEAT TRANSFER INK RIBBON

BACKGROUND OF THE INVENTION

The present invention relates to a heat transfer ink ribbon which forms images on a printing medium upon heating by a thermal head or laser beam in response to signals. More particularly, the present invention relates to an improvement on a binder resin contained in the ink layer.

One of the heat transfer recording methods is the sublimation transfer recording method. This method employs an ink ribbon consisting of a heat-resistant substrate and an ink layer formed thereon which contains a sublimation dye. At the time of printing, the ink ribbon is placed on a printing medium such that the ink layer comes into close contact with the dye-accepting surface of the printing medium which is formed from a polyester resin. Printing is effected by heating the ink ribbon from the opposite side of the ink layer by means of a thermal head which produces a heating pattern in response to an image pattern to be transferred. Upon heating, the ink ribbon permits the sublimation dye to be transferred to the printing medium through sublimation. In this way a desired image is formed on the printing medium.

What is important for this kind of ink ribbon is gamma ($\gamma$), which is defined as the tangent of the slope of the straight line part of the characteristic curve obtained by plotting the amount of energy applied (on the abscissa) against the reflection density of transferred ink (on the ordinate). Gamma determines the properties of an ink ribbon. A high gamma value is desirable if printing with a high density is to be performed in a shorter time. (The currently available ink ribbon takes 60–90 seconds for printing.) On the other hand, a high gamma value is undesirable where an image needs gradation. With a high gamma value, it is difficult to reproduce the gradation of a photograph which usually has a density in the range of 0.3 to 0.8. The poor reproducibility is due partly to heat accumulation in the thermal head and partly to fluctuation in the heating time. Several attempts have been made to eliminate these drawbacks by changing the ratio of the dye to the binder resin or by changing the kind of the binder resin.

Changing the ratio of the dye to the binder resin has a good effect on the high-density part but has a very little effect on the low-density part. For the ink ribbon to reproduce the gradation at an adequate printing speed, it is desirable that the gamma value be small for the low-density part and large for the high-density part. This is not achieved by the above-mentioned remedy.

The conventional binder resin used for the ink ribbon includes cellulose, polyvinyl butyral, polyvinyl acetal resins (e.g., polyvinyl acetoacetal), and vinyl chloride resins. These resins do not reproduce gradation satisfactorily because they vary in gamma depending on the amount of energy applied.

SUMMARY OF THE INVENTION

The present invention was completed in view of the foregoing. Accordingly, it is an object of the present invention to provide a heat transfer ink ribbon superior in gradation reproducibility.

In order to achieve the above-mentioned object, the present inventors carried out a series of researches over a long period of time. As the result, it was found that a good result is obtained if the binder resin in the ink ribbon is grafted with a vinyl compound of cyclic structure. The present invention is based on this finding. The gist of the present invention resides in a heat transfer ink ribbon which comprises a substrate and an ink layer formed thereon containing a binder resin and a dye which transfers to a printing medium upon heating, said binder resin being a graft polymer formed by grafting 100 parts by weight of a backbone polymer with 3–30 parts by weight of a vinyl compound of cyclic structure having a ring comprised of 4 or more atoms, with the graft ratio being 0.5–15 parts by weight.

DESCRIPTION OF THE PREFERRED EMBODIMENTS

According to the present invention, the heat transfer ink ribbon contains a binder resin the principal component of which is a graft polymer formed by grafting a backbone polymer with a vinyl compound of cyclic structure having a ring comprised of 4 or more atoms. The backbone polymer is not specifically limited so long as it permits the grafting with a vinyl compound (mentioned later). A polyvinyl acetal resin or vinyl chloride-acryl copolymer is desirable because of its mechanical and physical properties. Examples of the polyvinyl acetal resin include polyvinyl butyral, polyvinyl acetoacetal, and polyvinyl formal. Examples of the vinyl chloride-acryl copolymer include copolymers of vinyl chloride with an acrylic monomer such as acrylic acid, acrylate ester, methacrylic acid, and methacrylate ester. Additional examples of the backbone polymer include poval resin, chlorinated vinyl resin, chlorinated polyolefin, acryl-modified chlorinated vinyl resin, polypropylene, polyethylene, vinyl acetate, ethylene-vinyl acetate copolymer, polybutadiene, natural rubber, polyisoprene, cellulose ester, cellulose ether, acrylic resin, and polyester resin.

The vinyl compound to form branch polymers is one which is represented by the formula (1) or (2) below.

$$CH_2{=}CR^1{-}\underset{\underset{O}{\|}}{C}{-}O{-}R^2 \qquad (1)$$

(where $R^1$ denotes hydrogen or a methyl group.)

$$CH_2{=}CH{-}R^2 \qquad (2)$$

This vinyl compound is characterized by its cyclic substituent group $R^2$ comprised of 4 or more atoms. The substituent group $R^2$ is not specifically limited so long as it is comprised of 4 or more atoms. It should preferably be of aliphatic cyclic structure. Examples of the vinyl compound having the cyclic substituent group $R^2$ are listed below.

(1) Isobornyl (meth)acrylate

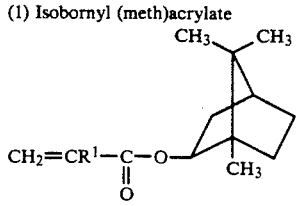

(2) Dicyclopentenyloxyethyl (meth)acrylate

-continued

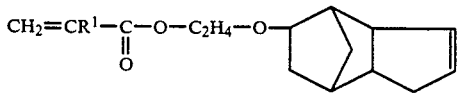

(3) Cyclohexyl (meth)acrylate

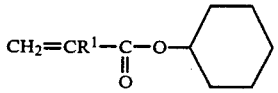

(4) Tetrahydrofurfuryl (meth)acrylate

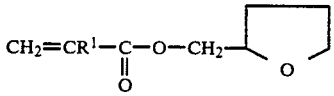

(5) Benzyl (meth)acrylate

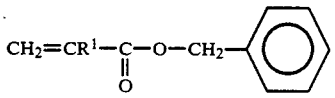

(6) Phenoxyethyl (meth)acrylate

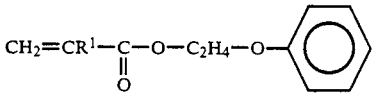

(7) Adamantyl (meth)acrylate

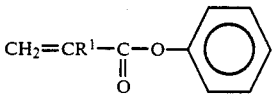

(8) Vinylpyrrolidone

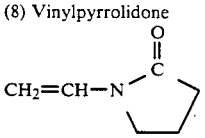

(9) Styrene

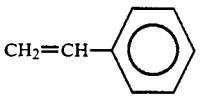

(10) Chlorostyrene

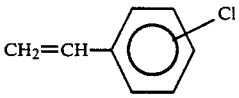

The above-mentioned vinyl compound may be used for grafting in combination with any other vinyl compound which is copolymerizable with it without any adverse effect. Examples of the vinyl compound include methyl (meth)acrylate, ethyl (meth)acrylate, butyl (meth)acrylate, 2-ethylhexyl (meth)acrylate, acrylic acid, methacrylic acid, itaconic acid, vinyl acetate, and vinyl propionate.

The vinyl compound to form the branch polymer is introduced by graft polymerization into the backbone polymer of polyvinyl acetal resin or vinyl chloride-acryl copolymer. The graft polymerization may be carried out by one of the following known processes.

One process consists of dissolving a polyvinyl acetal resin in a solvent and adding to the solvent solution the above-mentioned vinyl compound (monomer) together with an organic peroxide. The organic peroxide generates radicals which attack the vinyl acetate segment of the vinyl acetal resin, thereby causing the vinyl compound to graft to the backbone polymer.

Another process consists of modifying a polyvinyl acetal resin with a (meth)acryloyl group and then reacting the modified polyvinyl acetal resin for grafting with the above-mentioned vinyl compound together with a polymerization initiator. (The modification is the addition of a (meth)acryloyl group by the reaction of the OH group of the polyvinyl acetal resin with a (meth)acrylate containing an isocyanate group.) This process gives rise to a graft polymer and a homopolymer of the vinyl compound simultaneously because grafting is performed by radical polymerization of an unsaturated monomer.

Examples of the (meth)acrylate containing an isocyanate group (used in the second process to introduce (meth)acryloyl groups into the backbone polymer) include the following.

(a) 2-Isocyanate ethylmethacrylate

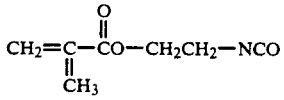

(b) Condensation product of hydroxypropyl acrylate and isophorone diisocyanate

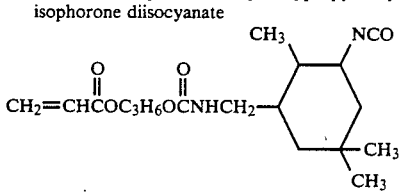

Additional examples of the (meth)acrylate having an isocyanate group include isocyanate acrylate which is prepared by the reaction of an acryl monomer having a functional group reactive to isocyanate with one of the isocyanate groups of a diisocyanate. Examples of the acryl monomer include hydroxyethyl (meth)acrylate, hydroxypropyl (meth)acrylate, (meth)acrylic acid, and aminoethyl (meth)acrylate. Examples of the diisocyanate include tolylene diisocyanate, diphenylmethane diisocyanate, hexamethylene diisocyanate, isophorone diisocyanate, and xylylene diisocyanate. A typical example of the isocyanate acrylate of this type is "UM-2100", a product of Negami Kogyo Co., Ltd. The isocyanate acrylate can be synthesized directly as in the case of ordinary acrylate. A typical example of the isocyanate acrylate of this type is 2-isocyanate ethylmethacrylate ("MOI" made by Showa Rodia Co., Ltd.).

According to the present invention, the above-mentioned vinyl compound is grafted to a backbone polymer (polyvinyl acetal resin or vinyl chloride-acryl copolymer). The amount of the vinyl compound should be 1–30 parts by weight for 100 parts by weight of the backbone polymer, and the graft ratio should be 0.5–15 parts by weight for 100 parts by weight of the backbone polymer. With a graft ratio smaller than 0.5, the resulting polymer does not have the desired properties. With a graft ratio larger than 15, the resulting polymer is poor in coating performance due to gelation.

The graft polymer prepared as mentioned above is subsequently incorporated with a sublimation dye and optional additives such as antioxidant, surface active agent (leveling agent), silicone oil, fluorine surface active agent, inorganic filler, organic filler, and mold release agent. The resulting compound becomes an ink layer when applied to a substrate film. In this way the ink ribbon is prepared. There are no specific restrictions on the sublimation dye and additives. They may be selected from those which are commonly used for this kind of ink ribbon.

The heat transfer ink ribbon of the present invention gives a high quality image with smooth gradation, owing to the binder resin which is a graft polymer formed by grafting the backbone polymer with a compound of cyclic structure.

EXAMPLES

The invention will be described in more detail with reference to the following examples, in which the heat transfer ink ribbon was made with one of the graft polymers A to K prepared as follows:

Graft polymer A

Graft polymerization was carried out by dissolving in 150 parts by weight of ethyl acetate 70 parts by weight of polyvinyl butyral ("3000K" made by Denki Kagaku Kogyo K.K.), 15 parts by weight of isobornyl acrylate, 15 parts by weight of vinyl acetate, and a polymerization initiator composed of 0.7 part by weight of benzoyl peroxide and 0.3 part by weight of lauryl peroxide, and then heating the solution at 80° C. for 10 hours, with the atmosphere above the solution replaced by nitrogen. The reaction was continued for 4 hours after the further addition of 1.0 part by weight of lauryl peroxide and 30 parts by weight of ethyl acetate. Finally, the solution was diluted with 220 parts by weight of ethyl acetate and cooled. Thus there was obtained a solution of butyral-acryl graft polymer.

The solution was found to contain 19.6% of resin and have a Brookfield viscosity of 1800 cps (at 23° C.)

The butyral-acryl graft polymer and the polyvinyl butyral (as a raw material) were tested for molecular weight distribution by gel permeation chromatography (with polystyrene as reference). A fraction of the butyralacryl graft polymer was collected whose molecular weight distribution does not overlap with that of the polyvinyl butyral. This fraction was analyzed by infrared absorption spectrometry, and the intensity of absorption was measured at 2940 $cm^{-1}$ (due to the stretching vibration of C—H in polyvinyl butyral, isobornyl acrylate, and vinyl acetate) and at 1450 $cm^{-1}$ (due to specific absorption by isobornyl acrylate). The measured values were compared to calculate the content of isobornyl acrylate. The result indicates that the ratio of polyvinyl butyral to isobornyl acrylate is 100:8. This ratio suggests that 100% of the isobornyl acrylate used was grafted to the polyvinyl butyral because it seems impossible that the homopolymerization of isobornyl acrylate gives a polymer of such a high molecular weight. If it is assumed that isobornyl acrylate is grafted to the individual molecules (with different molecular weight) of polyvinyl butyral in a uniform ratio, the ratio of polyvinyl butyral to isobornyl acrylate in the graft polymer would be 100:8.

It is concluded from the foregoing that the butyralacryl graft polymer in this example is composed of polyvinyl butyral and isobornyl acrylate, with the graft ratio of the latter being 8%.

Graft polymer B

The same procedure as in the case of graft polymer A was repeated, except that the isobornyl acrylate was replaced by cyclohexyl methacrylate. There was obtained a solution of butyral-acryl graft polymer containing 19.7% resin and having a viscosity of 1000 cps.

The graft polymer was found to have a graft ratio of 9%, which was calculated in the same manner as in the case of graft polymer A from the infrared absorption spectrometry at 2940 $cm^{-1}$ and 1450 $cm^{-1}$ (due to specific absorption by cyclohexyl group).

Graft polymer C

The same procedure as in the case of graft polymer A was repeated, except that the isobornyl acrylate was replaced by tetrahydrofuran methacrylate. There was obtained a solution of butyral-acryl graft polymer containing 19.4% resin and having a viscosity of 2100 cps.

The graft polymer was found to have a graft ratio of 10%, which was calculated in the same manner as in the case of graft polymer A from the infrared absorption spectrometry at 2940 $cm^{-1}$ and 1070 $cm^{-1}$ (due to specific absorption by the ring of tetrahydrofuran).

Graft polymer D

The same procedure as in the case of graft polymer A was repeated, except that the isobornyl acrylate was replaced by vinylpyrrolidone. There was obtained a solution of butyral-vinylpyrrolidone graft polymer containing 19.6% resin and having a viscosity of 1400 cps.

The graft polymer was found to have a graft ratio of 8%, which was calculated in the same manner as in the case of graft polymer A from the infrared absorption spectrometry at 2940 $cm^{-1}$ and 1680 $cm^{-1}$ (due to stretching vibration of C=O in vinylpyrrolidone).

Graft polymer E

The same procedure as in the case of graft polymer A was repeated, except that the amount of polyvinyl butyral was changed to 92 parts by weight, the amount of isobornyl acrylate was changed to 3 parts by weight, and the amount of vinyl acetate was changed to 5 parts by weight. There was obtained a solution of butyral-acrylate graft polymer containing 19.7% resin and having a viscosity of 4200 cps.

The graft polymer was found to have a graft ratio of 2%, which was calculated in the same manner as in the case of graft polymer A.

Graft polymer F

The same procedure as in the case of graft polymer A was repeated, except that the amount of isobornyl acrylate was changed to 30 parts by weight and vinyl acetate was not used. There was obtained a solution of butyral-acrylate graft polymer containing 20.0% resin and having a viscosity of 3800 cps.

The graft polymer was found to have a graft ratio of 13%, which was calculated in the same manner as in the case of graft polymer A.

Graft polymer G

In 218 parts by weight of ethyl acetate were dissolved 70 parts by weight of vinyl chloride-acryl copolymer ("S-LecE-C110" made by Sekisui Chemical Co., Ltd.), 2.8 parts by weight of isocyanate acrylate ("NU-2100" made by Negami Kogyo Co., Ltd.), and 0.04 part by weight of dibutyltin dilaurate. The solution was heated at 80° C. for 7 hours to carry out reaction between the hydroxyl group of the vinyl chloride-acryl copolymer and the isocyanate group of the isocyanate acrylate. The completion of the reaction was confirmed by noting that the solution does not give any longer a peak in the infrared absorption spectrum at 2240 $cm^{-1}$ due to isocyanate.

Then, the solution (290.8 parts by weight) was mixed with 15 parts by weight of isobornyl acrylate, 15 parts by weight of vinyl acetate, 21.8 parts by weight of ethyl acetate, and 0.6 part by weight of azobisisobutyronitrile (polymerization initiator). The solution underwent polymerization reaction at 80° C. for 8 hours. The reaction was continued for 4 hours after the further addition of 0.6 part by weight of azobisisobutyronitrile and 5 parts by weight of ethyl acetate. Finally, the solution was diluted with 166.4 parts by weight of ethyl acetate and cooled. Thus there was obtained a solution of butyral-acryl graft polymer.

The solution of the graft polymer was found to contain 19.8% of resin and have a viscosity of 500 cps.

The resulting graft polymer was found to have a graft ratio of 10% by infrared absorption spectrometry (as in the case of graft polymer A) in which the intensity of absorption was measured at 1730 $cm^{-1}$ (due to the stretching vibration of C—O in vinyl chloride-acryl copolymer, isobornyl acrylate, and vinyl acetate) and at 1050 $cm^{-1}$ (due to specific absorption by isobornyl acrylate).

Graft polymer H

The same procedure as in the case of graft polymer A was repeated, except that the amount of polyvinyl butyral was changed to 94 parts by weight, the amount of isobornyl acrylate was changed to 1 part by weight, and the amount of vinyl acetate was changed to 5 parts by weight. There was obtained a solution of butyral-acrylate graft polymer containing 20.0% resin and having a viscosity of 4000 cps.

The graft polymer was found to have a graft ratio of 1%, which was calculated in the same manner as in the case of graft polymer A.

Graft polymer I

The same procedure as in the case of graft polymer A was repeated, except that the amount of polyvinyl butyral was changed to 60 parts by weight, the amount of isobornyl acrylate was changed to 35 parts by weight, and the amount of vinyl acetate was changed to 5 parts by weight. There was obtained a solution of butyral-acrylate graft polymer containing 19.8% resin and having a viscosity of 4100 cps.

The graft polymer was found to have a graft ratio of 15%, which was calculated in the same manner as in the case of graft polymer A.

Graft polymer J

Graft polymerization was carried out by dissolving in 150 parts by weight of ethyl acetate 70 parts by weight of polyvinyl butyral ("3000K" made by Denki Kagaku Kogyo K.K.), 15 parts by weight of isobornyl acrylate, 15 parts by weight of vinyl acetate, and 0.4 part by weight of azobisisobutyronitrile (polymerization initiator), and then heating the solution at 80° C. for 10 hours, with the atmosphere above the solution replaced by nitrogen. The reaction was continued for 4 hours after the further addition of 1.0 part by weight of azobisisobutyronitrile and 30 parts by weight of ethyl acetate. Finally, the solution was diluted with 220 parts by weight of ethyl acetate and cooled. Thus there was obtained a solution of butyral-acryl graft polymer.

The solution was found to contain 19.6% resin and have a viscosity of 860 cps.

The graft polymer was found to have a graft ratio of 0%, which was calculated in the same manner as in the case of graft polymer A.

Graft polymer K

The same procedure as in the case of graft polymer A was repeated, except that isobornyl acrylate was not used and the amount of vinyl acetate was changed to 30 parts by weight. There was obtained a solution of butyral-acryl graft polymer containing 19.6% resin and having a viscosity of 1100 cps.

The graft polymer was found to have a graft ratio of 6%, which was calculated in the same manner as in the case of graft polymer A from the infrared absorption spectrometry at 1135 $cm^{-1}$ and 1240 $cm^{-1}$.

Each of the graft polymers prepared as mentioned above was evaluated in the following manner to see how it functions as a binder resin for the ink layer of a heat transfer ink ribbon. Ink for a heat transfer ink ribbon was prepared by compounding the graft polymer according to the following formulation.

Graft polymer 10.0 pbw

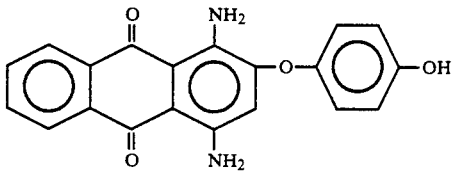

4.5 pbw

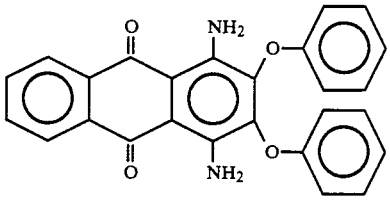

2.0 pbw

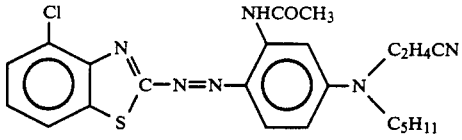

2.5 pbw

Methyl ethyl ketone 36.0 pbw

Toluene 36.0 pbw

Ethyl cellosolve 9.0 pbw

The thus prepared ink was applied to a 6-μm thick polyester film having a heat-resistant slip layer, using a gravure coater such that the coating layer was 1 μm thick after drying. Table 1 shows the designations of the graft polymers used in Examples and Comparative Examples. Incidentally, in Comparative Example 5, polyvinyl butyral without grafting was used as the binder. The heat transfer ink ribbons were evaluated by printing on printing paper having a dye reception layer formed from the following composition.

| | |
|---|---|
| Saturated polyester resin (UE3600 made by Unitica Co., Ltd.) | 25 pbw |
| Isocyanate (Takenate D110N made by Takeda Yakuhin) | 1 pbw |
| Silicone oil (SF8427 made by Toray Dow Corning Silicone) | 0.2 pbw |
| Methyl ethyl ketone | 30 pbw |
| Toluene | 45 pbw |

The printing paper was prepared by coating synthetic paper (YUPO FPG-150 made by Oji Yuka Co., Ltd.) with this composition using a bar coater such that the coating layer was 10 μm thick after drying. The coating was followed by curing at 50° C. for 3 days.

The above-mentioned heat transfer ink ribbon and printing paper underwent printing test under the following conditions.

| | |
|---|---|
| Head resistance: | 2 kΩ |
| Voltage: | 18 kV |
| Pulse time: | 9 ms and 20 ms |

The printed matter was tested for reflection density using a Macbeth reflection density meter (TR-927). The results are shown in Table 1.

TABLE 1

| Example No. | Designation of graft polymer | Reflection density 9 ms (low) | Reflection density 20 ms (high) |
|---|---|---|---|
| Example 1 | A | 0.33 | 2.10 |
| Example 2 | B | 0.40 | 2.10 |
| Example 3 | C | 0.38 | 2.11 |
| Example 4 | D | 0.42 | 2.12 |
| Example 5 | E | 0.44 | 2.12 |
| Example 6 | F | 0.32 | 2.09 |
| Example 7 | G | 0.35 | 2.08 |
| Comparative Example 1 | H | 0.51 | 2.14 |
| Comparative Example 2 | I | 0.30 | 1.99 |
| Comparative Example 3 | J | 0.51 | 2.13 |
| Comparative Example 4 | K | 0.53 | 2.20 |
| Comparative Example 5 | — | 0.50 | 2.13 |

It is noted from Table 1 that the heat transfer ink ribbons in Examples 1 to 7 give a transferred image having smooth gamma characteristics (gradation) in the low tone region and a sufficient density in the high tone region. (In Examples 1 to 7, the binder resin is a graft polymer in which the branched chain is formed from a vinyl compound of cyclic structure.) By contrast, the heat transfer ink ribbons in Comparative Examples 1 to 5 give a transferred image having a rather high density in the low tone region. (In Comparative Examples 1 and 3, the graft polymer has a low graft ratio. In Comparative Example 5, the graft polymer is not used. In Comparative Example 4, the graft polymer is formed from a vinyl compound of non cyclic) structure. In Comparative Example 2, the graft polymer has the highest graft ratio, and the heat transfer ink ribbon gave an image having a low density not only in the low tone region but also in the high tone region.)

As mentioned above, the present invention provides a heat transfer ink ribbon that employs a binder resin formed by grafting a vinyl compound of cyclic structure. Owing to this binder resin, the heat transfer ink ribbon gives a high-quality image with smooth gradation, especially in the low and medium tone regions.

What is claimed is:

1. A heat transfer ink ribbon comprising a substrate and an ink layer formed thereon containing a binder resin and a dye which transfers to a printing medium upon heating, said binder resin being a graft polymer formed by grafting 100 parts by weight of a back-bone polymer with 3–30 parts by weight of a vinyl compound with the graft ratio being 0.5–15 parts by weight, said vinyl compound being selected from the following.

(1) Isobornyl (meth)acrylate

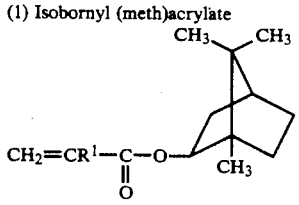

(2) Dicyclopentenyloxyethyl (meth)acrylate

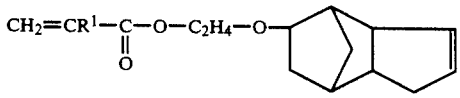

(3) Cyclohexyl (meth)acrylate

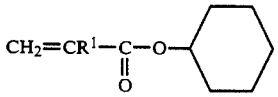

(4) Tetrahydrofurfuryl (meth)acrylate

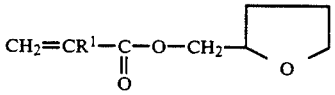

(5) Benzyl (meth)acrylate

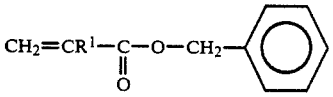

(6) Phenoxyethyl (meth)acrylate

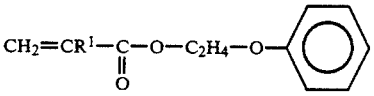

(7) Adamantyl (meth)acrylate

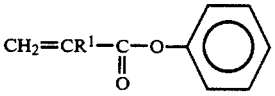

(8) Vinylpyrrolidone

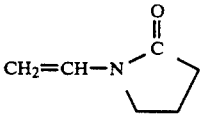

where $R^1$ denotes hydrogen or a methyl group.

2. A heat transfer ink ribbon according to claim 1, wherein the backbone polymer is polyvinyl acetal resin or vinyl chloride-acryl copolymer.

* * * * *